US006445118B1

(12) United States Patent
Shimizu et al.

(10) Patent No.: US 6,445,118 B1
(45) Date of Patent: Sep. 3, 2002

(54) LAMP HAVING CONDUCTOR STRUCTURE AND NON-CONDUCTOR STRUCTURE PROVIDED BETWEEN FILAMENTS

(75) Inventors: Masanori Shimizu, Kyoto; Kazuaki Ohkubo, Osaka; Takeshi Arakawa, Kyoto; Yoshinori Tanabe; Kenjiro Hashimoto, both of Osaka; Yoko Shimomura, Nara, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/538,630

(22) Filed: Mar. 29, 2000

(30) Foreign Application Priority Data

Mar. 30, 1999 (JP) ..... 11-088712

(51) Int. Cl.[7] ..... H01J 1/62; H01J 63/04

(52) U.S. Cl. ..... 313/484; 313/485; 313/491; 313/492; 313/146; 313/590

(58) Field of Search ..... 313/484, 485, 313/491, 493, 346 R, 631, 635, 492, 146, 147, 590, 613

(56) References Cited

U.S. PATENT DOCUMENTS

| | | | | | |
|---|---|---|---|---|---|
| 3,617,792 | A | * | 11/1971 | Lake | 313/484 |
| 3,714,492 | A | * | 1/1973 | Roche | 313/485 |
| 3,753,036 | A | * | 8/1973 | Roche | 315/60 |
| 3,898,503 | A | * | 8/1975 | Shurgan | 313/491 |
| 3,898,511 | A | * | 8/1975 | Johnson et al. | 313/490 |
| 4,032,814 | A | * | 6/1977 | Shurgan et al. | 313/492 |
| 4,204,137 | A | * | 5/1980 | Roy | 313/491 |
| 4,434,385 | A | * | 2/1984 | Touho et al. | 313/161 |
| 4,450,380 | A | * | 5/1984 | Proud et al. | 313/485 |
| 4,786,841 | A | * | 11/1988 | Fohl et al. | 313/493 |
| 4,891,551 | A | * | 1/1990 | Will et al. | 313/492 |
| 5,227,693 | A | * | 7/1993 | Sakakibara et al. | 313/493 |
| 5,498,924 | A | * | 3/1996 | Northrop | 313/486 |
| 5,585,694 | A | * | 12/1996 | Goldburt et al. | 313/491 |
| 5,686,795 | A | * | 11/1997 | Sakoske et al. | 313/613 |
| 5,804,914 | A | * | 9/1998 | Ozawa et al. | 313/493 |
| 5,818,164 | A | | 10/1998 | Winsor | 313/493 |

FOREIGN PATENT DOCUMENTS

| | | | |
|---|---|---|---|
| JP | 54142878 | A * | 11/1979 |
| JP | 54-142878 | | 11/1979 |
| JP | 55-157852 | | 12/1980 |
| JP | 60151947 | A * | 8/1985 |
| JP | 62-008440 | | 1/1987 |

OTHER PUBLICATIONS

Shimizu et al., "Two–Band Type Fluorescent Lamp", National Technical Report, vol. 43, No. 2, pp. 174–180 (Apr. 1997).*

* cited by examiner

*Primary Examiner*—Vip Patel
*Assistant Examiner*—Kevin Quarterman
(74) *Attorney, Agent, or Firm*—Renner, Otto, Boisselle & Sklar

(57) ABSTRACT

A fluorescent lamp of the present invention includes: a first electrode section having a first filament; a second electrode section having a second filament; a fluorescent tube in which a fluorescent substance Is applied on an inner wall of the fluorescent tube; a first structure of a nonconductor provided in the fluorescent tube: and a second structure of a conductor provided in the fluorescent tube. The first structure and the second structure are provided between the first filament and the second filament.

9 Claims, 15 Drawing Sheets

Side view

Front view

Wid[W]
18.0
17.5
17.0
16.5
16.0
15.5
15.0
14.5
d[mm]
0
5
10
20
30
40
50
60
61
62
63
64
65
Cathode glow space 51
Negative glow space 52
Faraday dark space 53
Positive column region 55
Cathode region 50

LAMP HAVING CONDUCTOR STRUCTURE AND NON-CONDUCTOR STRUCTURE PROVIDED BETWEEN FILAMENTS

BACKGROUND OF THE INVENTION

1. Field of the Invention

The present invention relates to an electric power saving fluorescent lamp.

2. Description of the Related Art

In recent years, efforts have been made in various fields of art for energy conservation in view of the global warming problem and in order to improve the efficiency of use of energy resources. In the field of fluorescent lamp equipment, various types of power saving fluorescent lamps have been developed.

Japanese Laid-Open Publication No. 62-8440 discloses an exemplary power saving fluorescent lamp. In FIG. 5 of Japanese Laid-Open Publication No. 62-8440, a non-conductor plate 20 provided in a fluorescent lamp is shown. The non-conductor plate 20 suppresses a discharge current between filament coils 4 and 4 of the fluorescent lamp. As a result, it is possible to reduce the power consumption of the fluorescent lamp.

However, the fluorescent lamp of Japanese Laid-Open Publication No. 62-8440 has a poor startability. This is because the non-conductor plate provided in the discharge current path inhibits the flow of electrons, thereby increasing the discharge starting voltage. Japanese Laid-Open Publication No. 62-8440 is silent about the poor startability of the fluorescent lamp and how to improve the startability.

SUMMARY OF THE INVENTION

According to one aspect of this invention, a fluorescent lamp includes: a first electrode section having a first filament; a second electrode section having a second filament; a fluorescent tube in which a fluorescent substance is applied on an inner wall of the fluorescent tube; a first structure of a non-conductor provided in the fluorescent tube; and a second structure of a conductor provided in the fluorescent tube. The first structure and the second structure are provided between the first filament and the second filament.

In one embodiment of the invention, the fluorescent lamp further includes a member for supporting the first structure, wherein the supporting member includes the second structure.

In one embodiment of the Invention, the second structure is electrically:insulated from the firs t filament.

In one embodiment of the invention, second structure is electrically connected to the first filament.

In one embodiment of the invention, the fluorescent substance has a two-band type spectral distribution capable of categorical color perception.

In one embodiment of the invention, a cathode region is defined in the vicinity of the first electrode section, and the first structure is provided in the cathode region.

In one embodiment of the invention, the first structure surrounds the first filament.

In one embodiment of the invention, a distance between the first structure and the first filament is 5 mm to 20 mm.

In one embodiment of the invention, a cross-sectional area of the first structure along a direction perpendicular to an axis of the fluorescent tube is equal to or greater than 20% of a cross-sectional area of the fluorescent tube along the direction perpendicular to the axis of the fluorescent tube.

In one embodiment of the invention, a fluorescent substance Is applied on the first structure and the second structure.

According to another aspect of this invention, a fluorescent lamp includes: a first electrode section having a first filament; a second electrode section having a second filament; a fluorescent tube for producing a fluorescent emission in response to a discharge current flowing between the first filament and the second filament; a non-conductor structure provided in the fluorescent tube; and a member for movably supporting the non-conductor structure. The supporting member supports the nonconductor structure so that at least a portion of the non-conductor structure is moved out of a path of the discharge current during a predetermined amount of time following start of flow of a discharge current, and the supporting member supports the non-conductor structure so that the non-conductor structure is moved in the discharge current path after the predetermined amount of time following the start of flow of a discharge current.

Thus, the invention described herein makes possible the advantages of providing a fluorescent lamp In which It is possible to reduce the power consumption while maintaining the startability.

These and other advantages of the present invention will become apparent to those skilled in the art upon reading and understanding the following detailed description with reference to the accompanying figures.

BRIEF DESCRIPTION OF THE DRAWINGS

DESCRIPTION OF THE PREFERRED EMBODIMENTS

Figure 1:
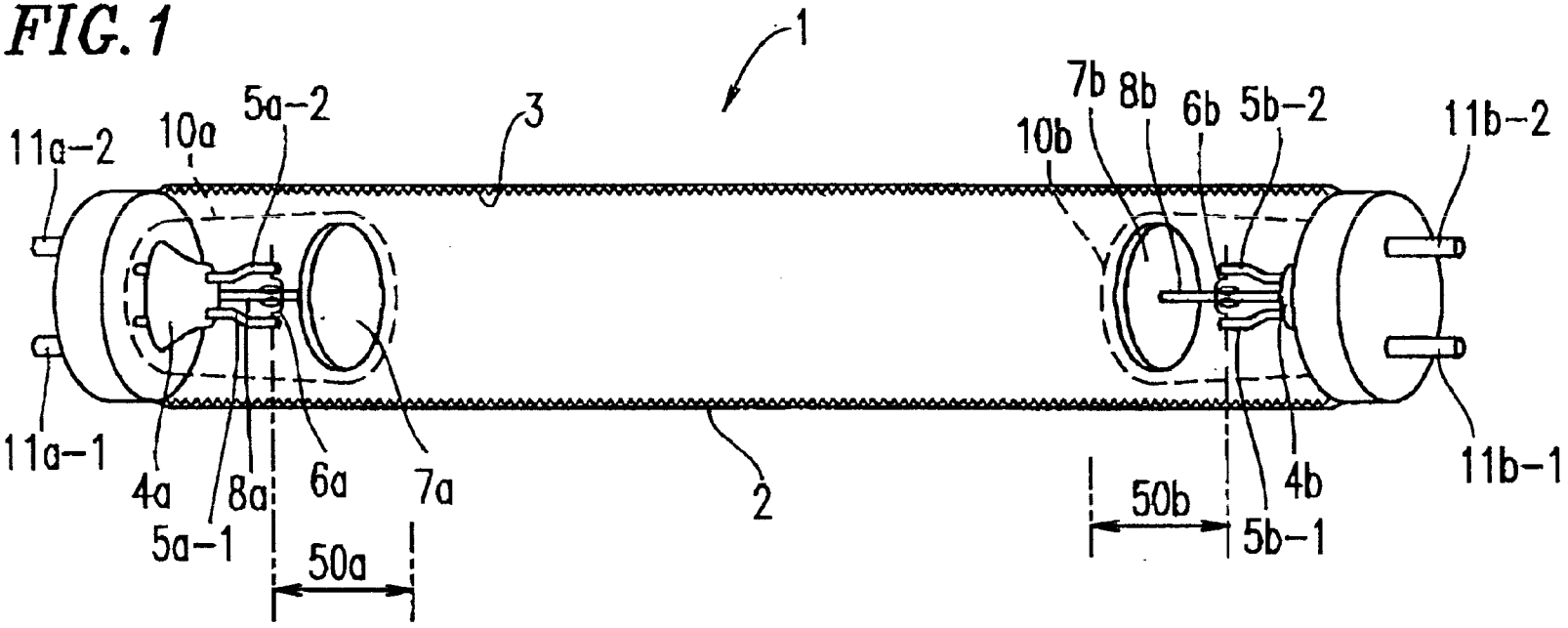

FIG. 1 illustrates a structure of a fluorescent lamp 1 according to Embodiment 1 of the present invention FIG.

Figure 2A:
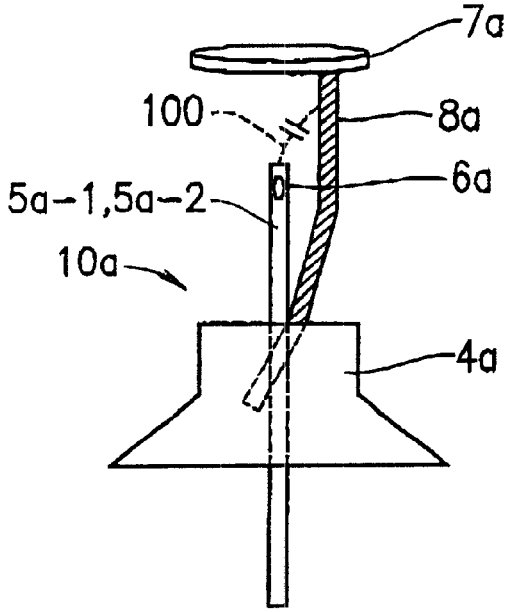
Figure 2B:
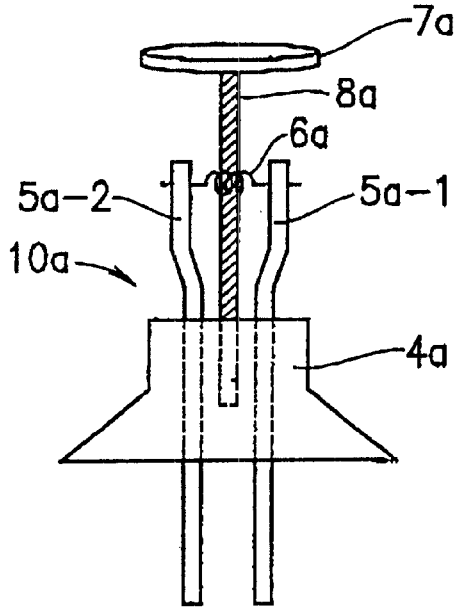
Figure 3:
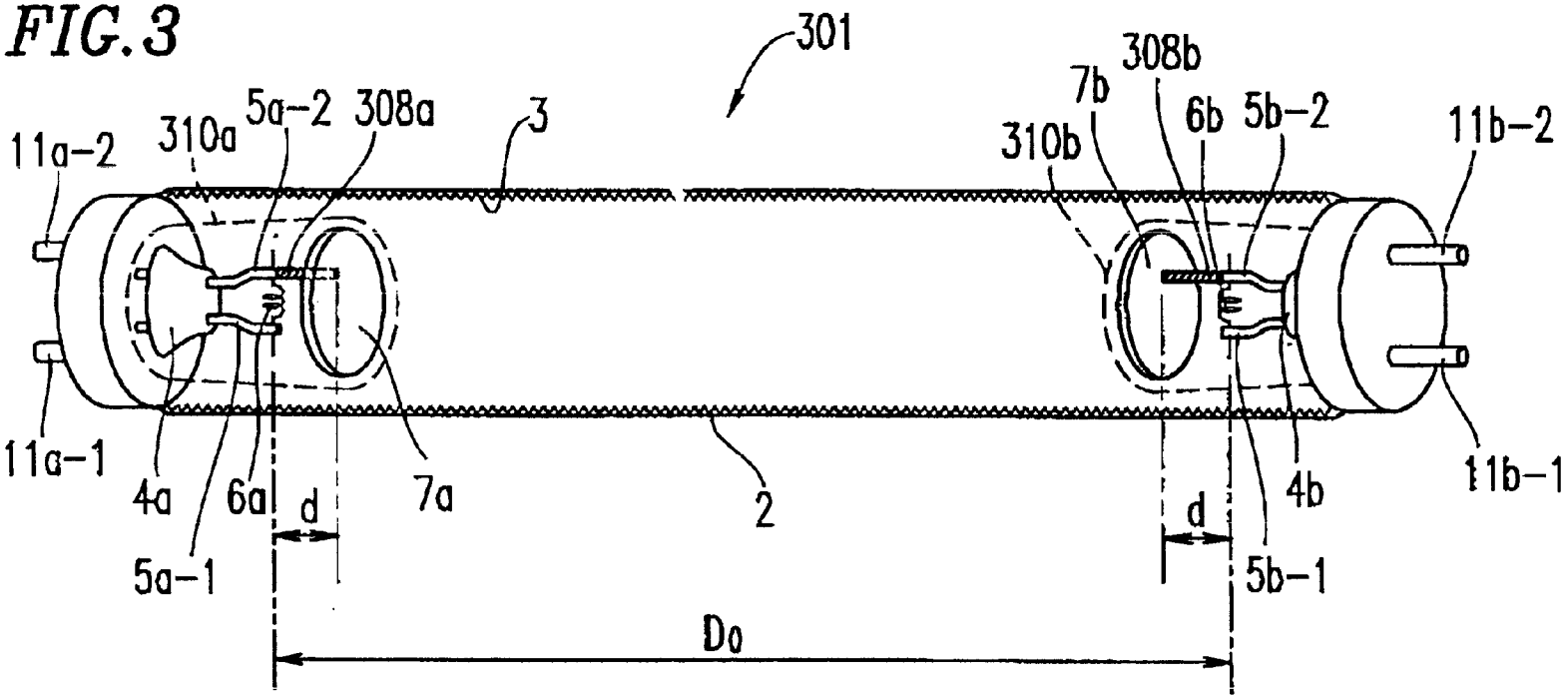
Figure 4:
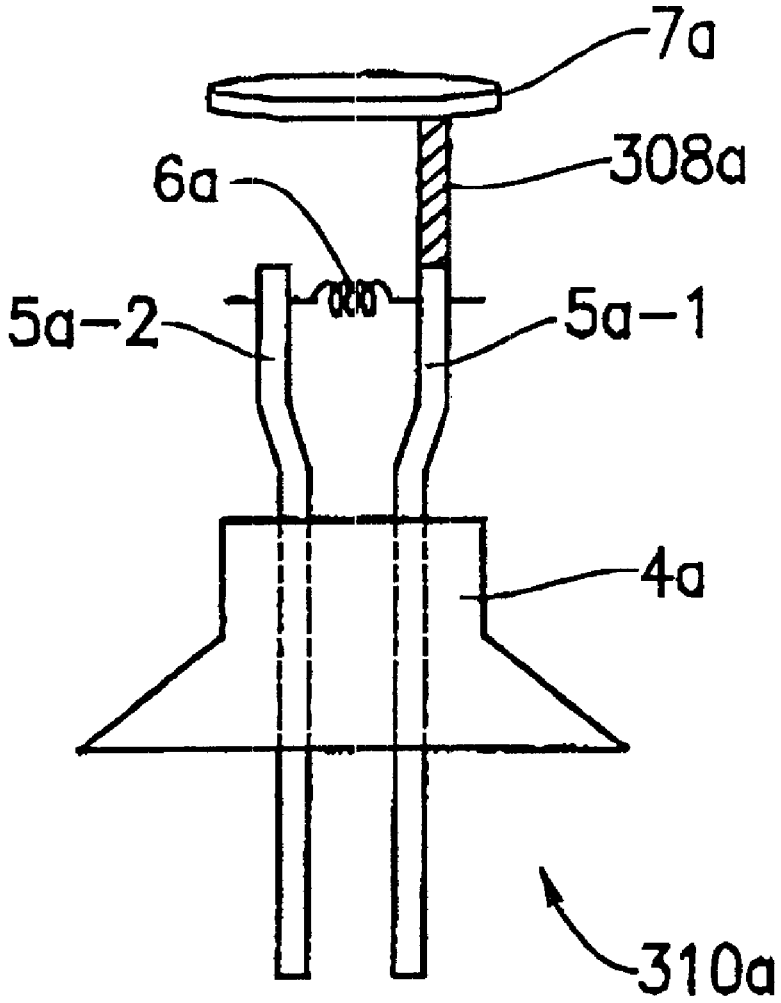
Figure 5:
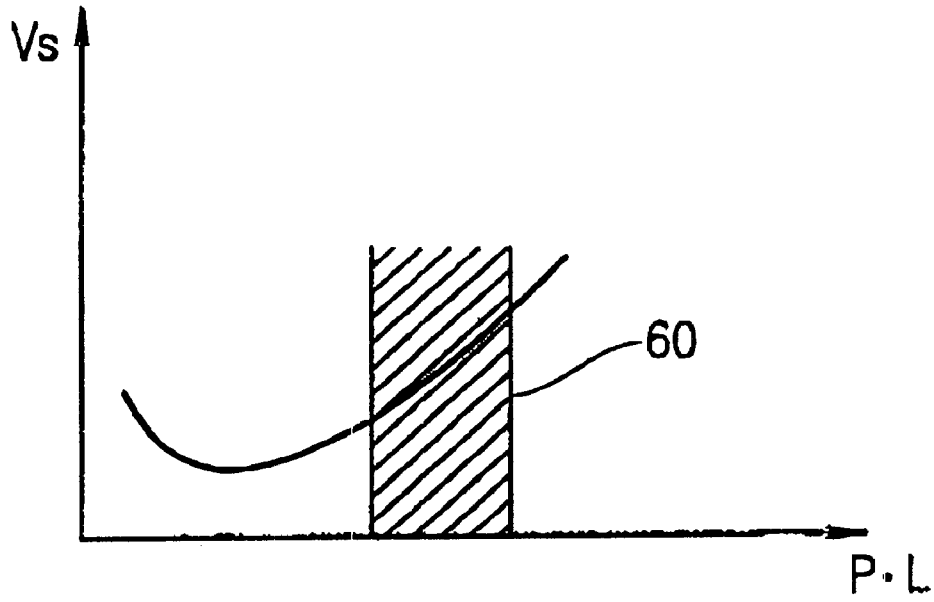

FIG. 2A is a Bide view illustrating an electrode section 10*a* shown in FIG. 1;

FIG. 2B is a front view illustrating the electrode section 10*a* shown In FIG. 1;

FIG. 3 illustrates a structure of a fluorescent lamp 301 according to Embodiment 1 of the present Invention:

FIG. 4 is a front view illustrating an electrode section 310*a* shown In FIG. 3;

FIG. 5 is a graph which illustrates Paschen's law.

Figure 6:
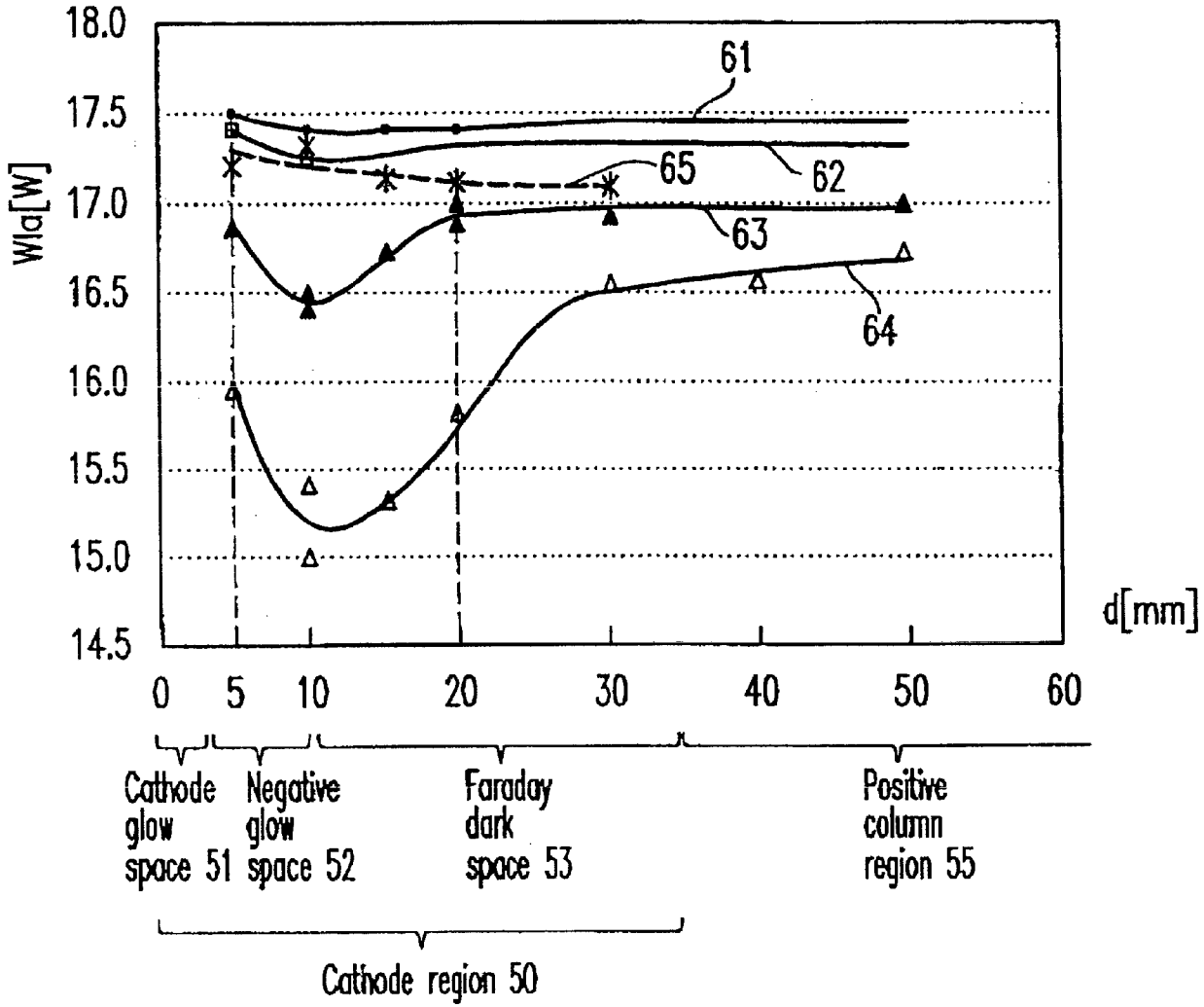
Figure 7:
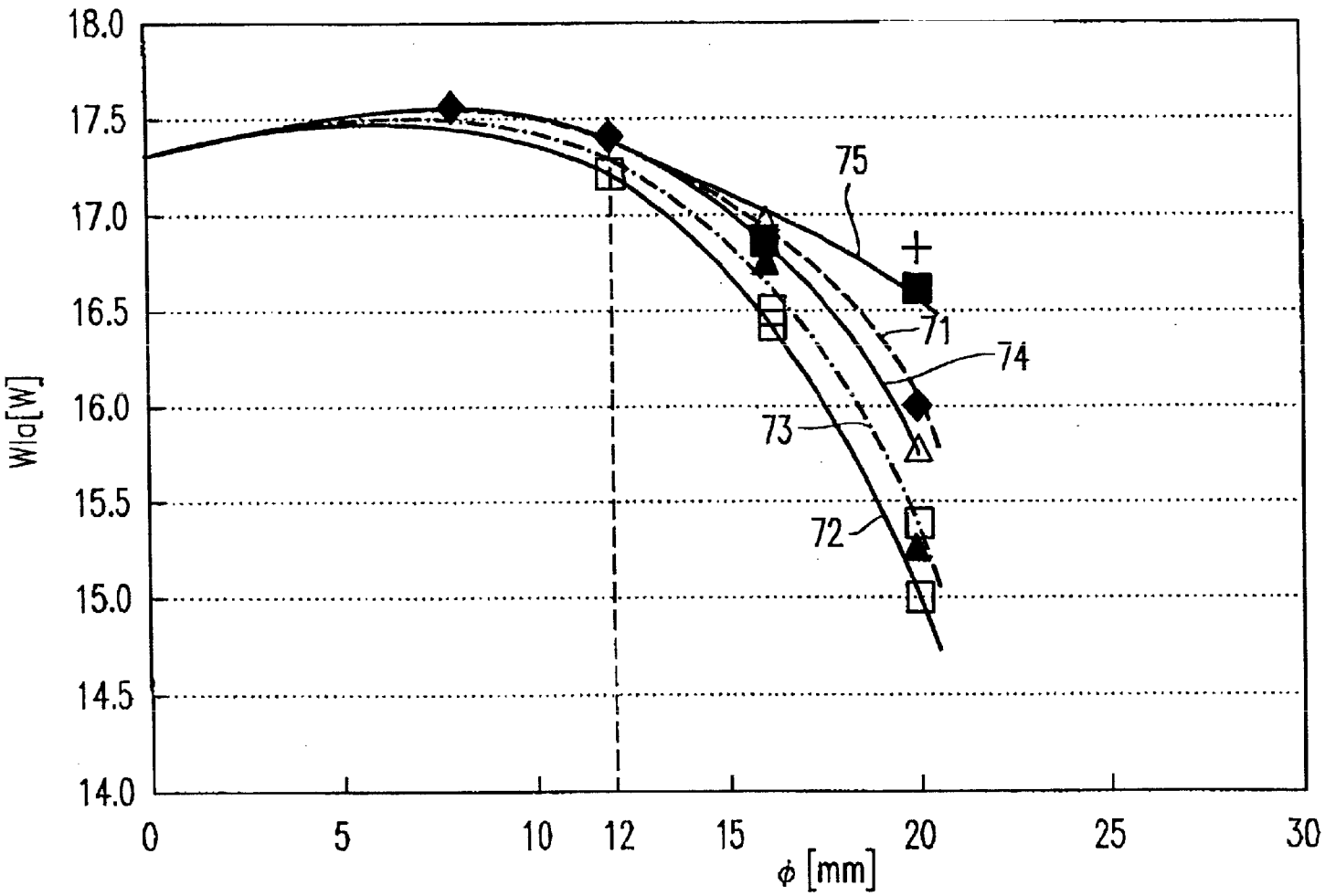
Figure 8:
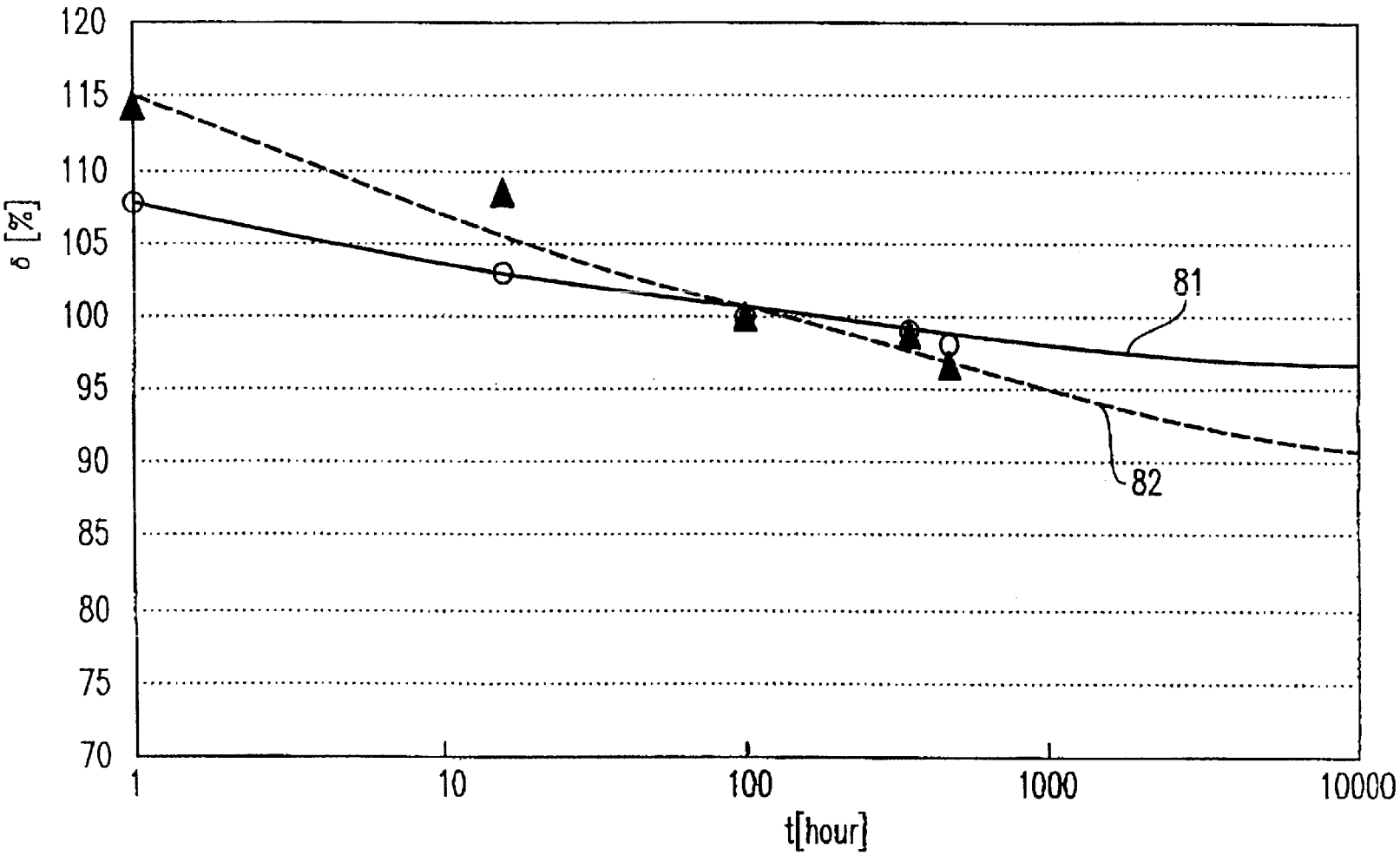
Figure 9A:
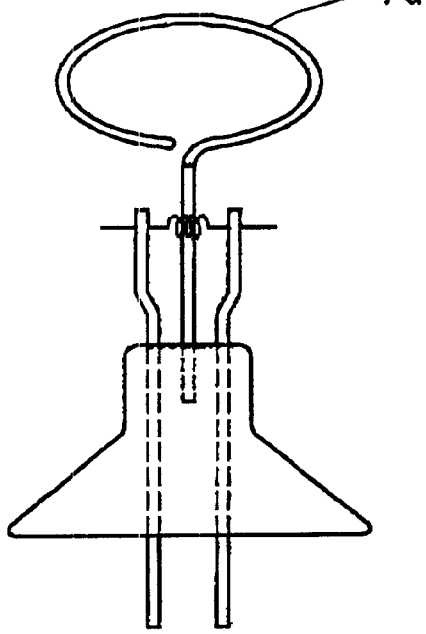
Figure 9B:
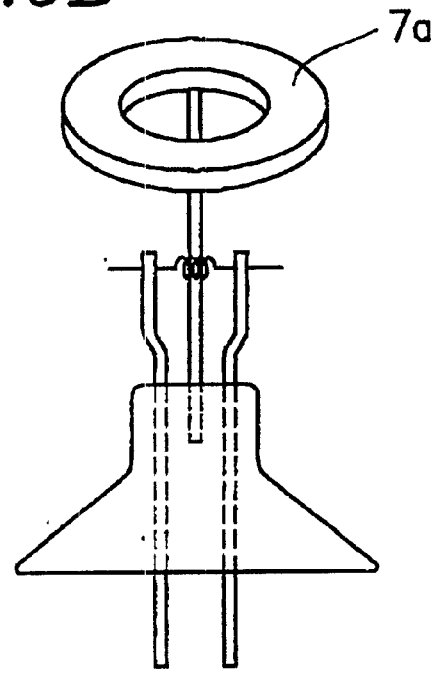
Figure 9C:
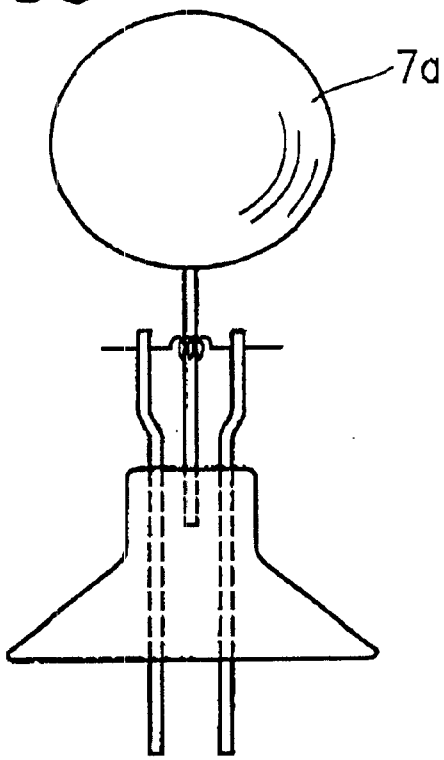
Figure 9D:
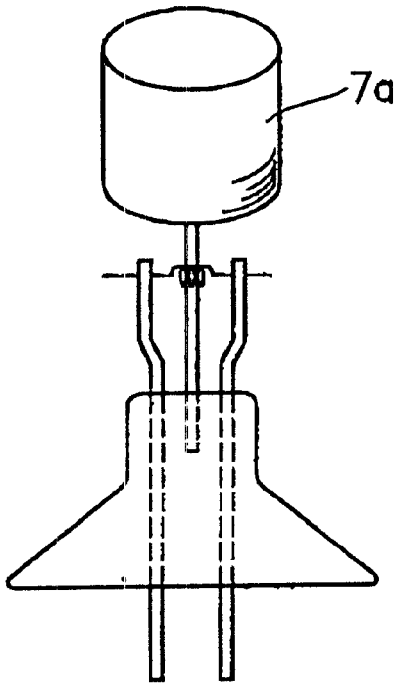
Figure 9E:
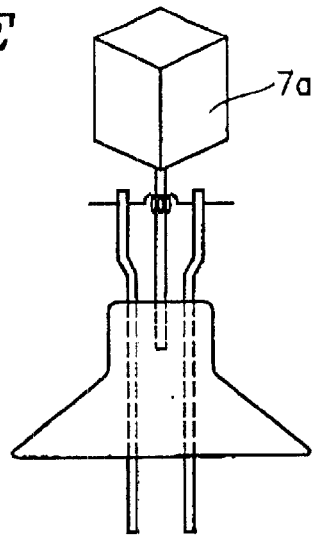
Figure 9F:
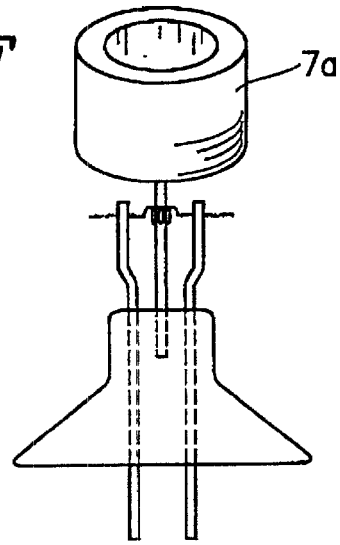
Figure 9G:
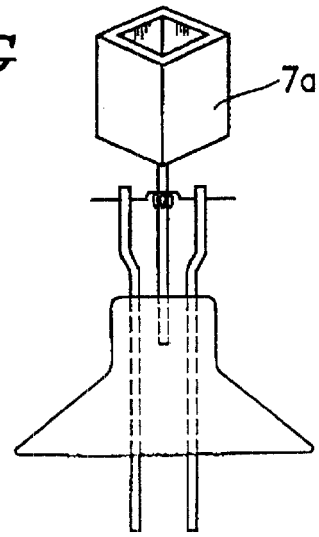
Figure 10A:
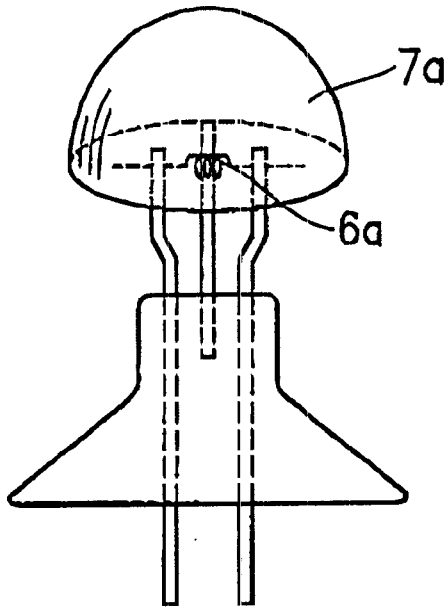
Figure 10B:
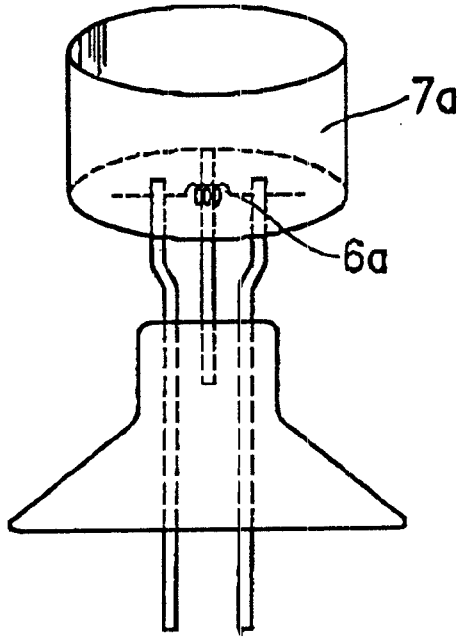
Figure 10C:
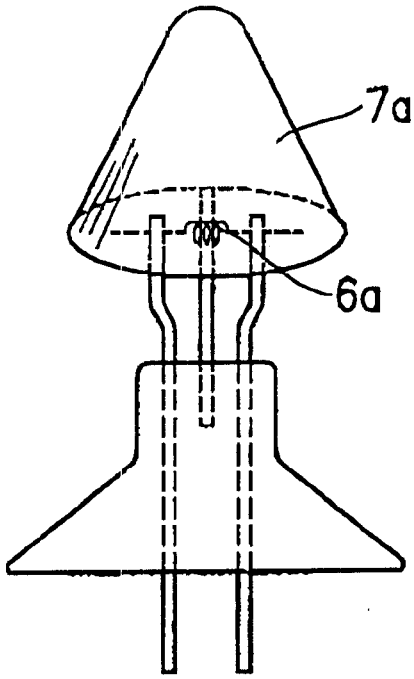
Figure 10D:
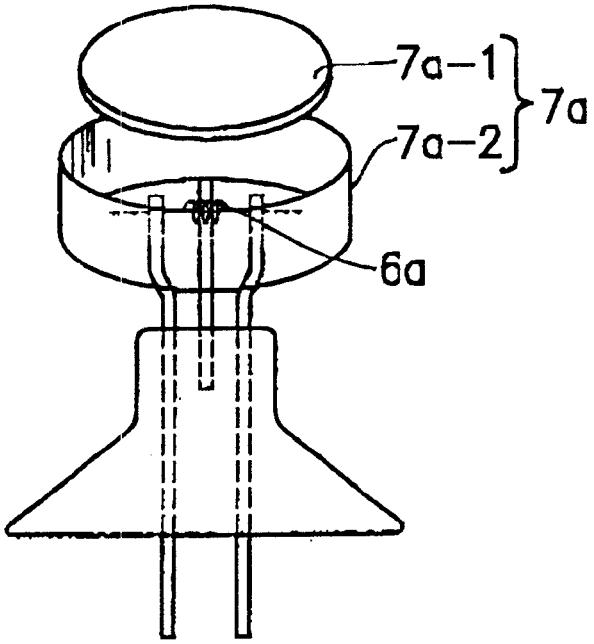
Figure 11A:
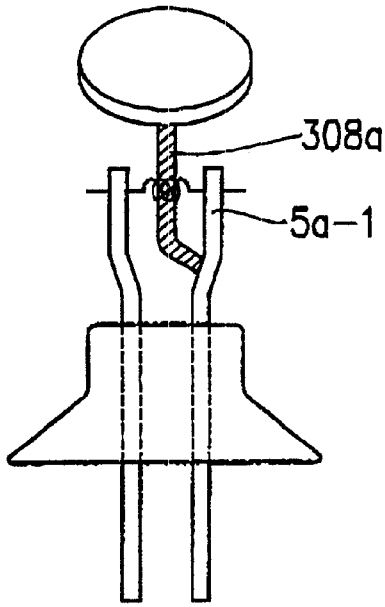
Figure 11B:
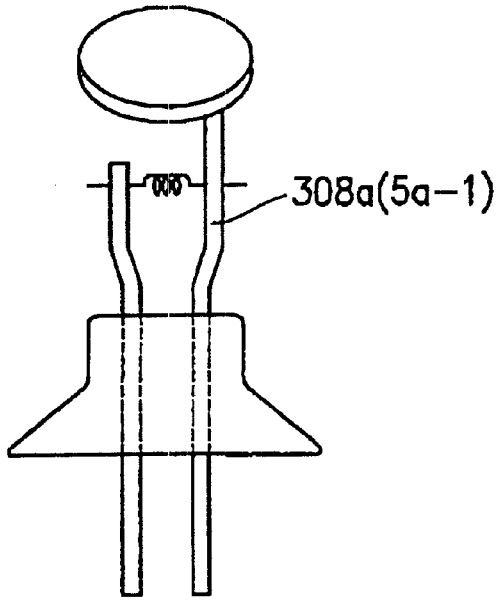
Figure 12A:
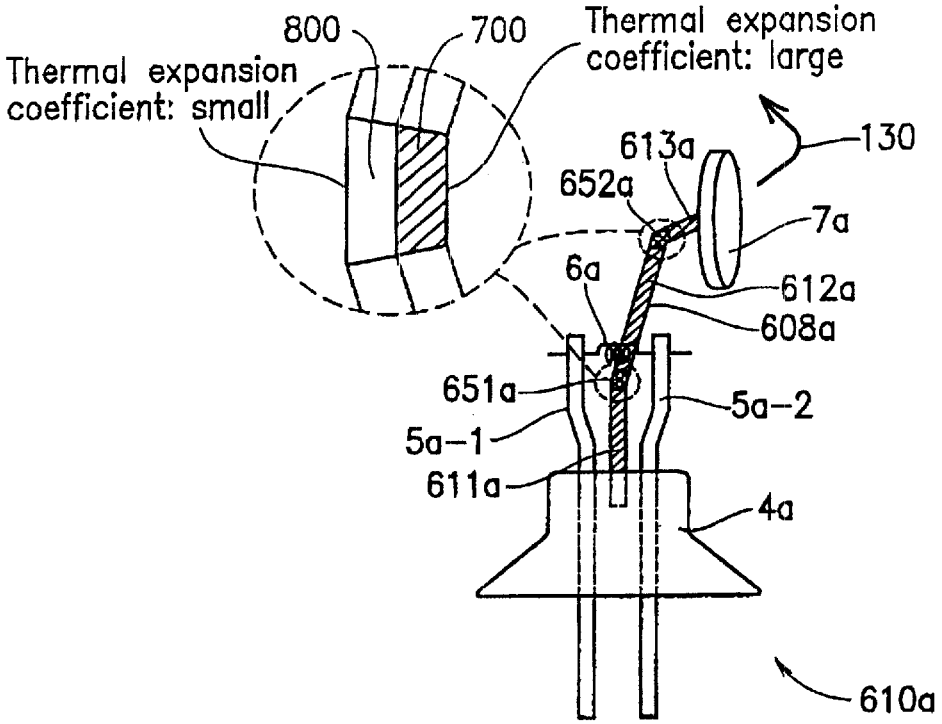
Figure 12B:
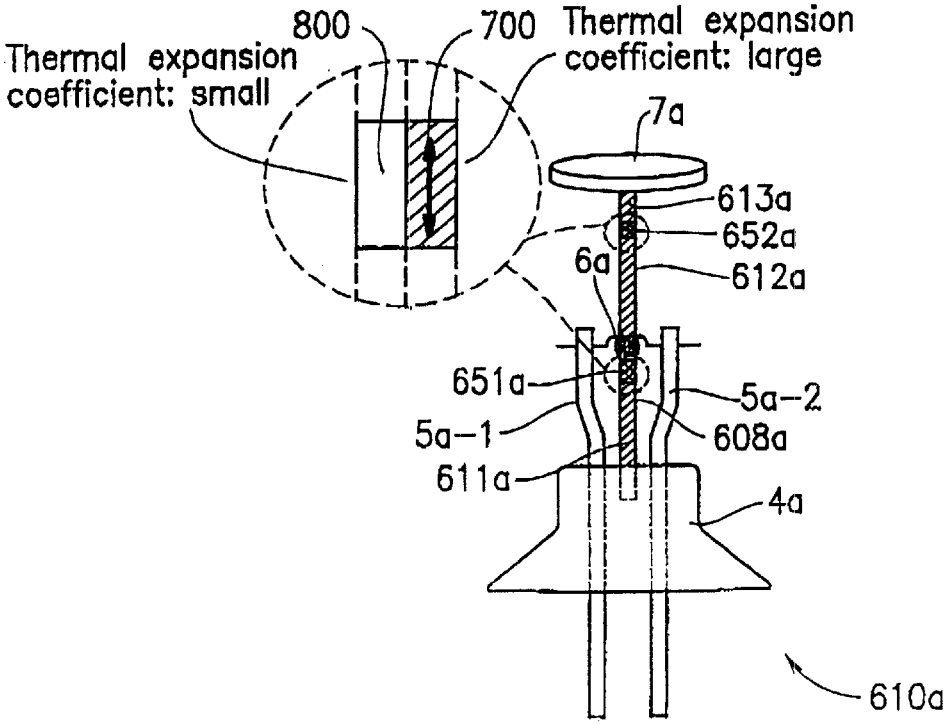

FIG. 6 illustrates the relationship between the distance d [mm] and the lamp electric power Wla [W] for the fluorescent lamp 301;

FIG. 7 illustrates the relationship between the diameter $\phi$ [mm] of the non-conductor structure provided in the fluorescent lamp 301 and the lamp electric power Wla [W];

FIG. 8 illustrates the relationship between the ON time t [hour] and the relative luminous flux density $\delta$ [%] for the fluorescent lamp 301;

FIG. 9A illustrates an example where a non-conductor structure 7*a* has a ring shape;

FIG. 9B illustrates an example where the non-conductor structure 7*a* has a disc shape with an aperture therein;

FIG. 9C illustrates an example where the non-conductor structure 7*a* has a spherical shape;

FIG. 9D Illustrates an example where the non-conductor structure 7*a* has a cylindrical shape;

FIG. 9E illustrates an example where the non-conductor structure 7*a* has a polygonal cylinder shape;

FIG. 9F illustrates an example where the non-conductor structure 7*a* has a hollow cylindrical shape;

FIG. 9G illustrates an example where the non-conductor structure 7*a* has a hollow polygonal cylinder shape;

FIG. 10A illustrates an example where the non-conductor structure 7*a* has a dome shape;

FIG. 10B illustrates an example where the non-conductor structure 7*a* has a tubular shape;

FIG. 10C illustrates an example where the non-conductor structure 7*a* has a cone shape;

FIG. 10D illustrates an example where the non-conductor structure 7*a* has a configuration including a combination of a disc and a tube;

FIG. 11A illustrates an example where a conductor structure 308*a* is connected to a lead-in wire 5*a*-1;

FIG. 11B illustrates an example where the conductor structure 308*a* is integral with the lead-in wire 5*a*-1;

FIG. 12A illustrates a structure of an electrode section 610*a* including a member 608*a* for movably supporting the non-conductor structure 7*a*; and FIG. 12B illustrates a structure of the electrode section 610*a* including the member 608*a* for movably supporting the non-conductor structure 7*a*.

Various embodiments of the present Invention will be described with reference to the accompanying drawings.

Embodiment 1

FIG. 1 illustrates a structure of a fluorescent lamp 1 according to Embodiment 1 of the present invention. The fluorescent lamp 1 includes a fluorescent tube 2, an electrode section 10*a* (first electrode section) provided at one end of the fluorescent tube 2, and an electrode section lob (second electrode section) provided at the other end of the fluorescent tube 2. The fluorescent tube 2 may be, for example, a glass tube.

Mercury and argon are charged in the fluorescent tube 2. Mercury emits a UV radiation for causing the fluorescent substance to produce a fluorescent emission. Argon is a rare gas for assisting initiation of discharge and preventing electrons from diffusing toward the inner wall of the fluorescent tube 2, thereby increasing the probability for the electrons to collide with mercury atoms. Alternative types of rare gas which can be charged in the fluorescent tube 2 include a mixed gas of argon with neon, krypton, or xenon.

When the fluorescent lamp 1 is attached to fluorescent lighting equipment (not shown), a filament 6*a* (first filament) is electrically connected to a glow starter circuit of the fluorescent lighting equipment via lead-in wires 5*a*-1 and 5*a*-2 and pins 11*a*-1 and 11*a*-2, and a filament 6*b* (second filament) is electrically connected to the glow starter circuit of the fluorescent lighting equipment via lead-in wires 5*b*-1 and 5*b*-2 and pins 11*b*-1 and 11*b*-2. The glow starter circuit provides a discharge current between the filament 6*a* and the filament 6*b*.

A fluorescent substance 3 is applied on the inner wall of the fluorescent tube 2. The UV radiation emitted in response to a discharge current flowing between the filament 6*a* of the electrode section 10*a* and the filament 6*b* of the electrode section 10*b* is converted by the fluorescent substance 3 Into visible light. In this way, the fluorescent tube 2 produces a fluorescent emission.

The fluorescent tube 2 further includes provided therein non-conductor structures 7*a* and 7*b* (first structures) and conductor structures 8*a* and 8*b* (second structures). The non-conductor structures 7*a* and 7*b* and the conductor structures 8*a* and 8*b* are provided between the filament 6*a* and the filament 6*b*. More specifically, the non-conductor structures 7*a* and 7*b* and the conductor structures 8*a* and 8*b* are provided in the path of a discharge current which would flow directly between the filament 6*a* and the filament 6*b* if such structures were not provided.

The term "non-conductor" as used herein includes, but is not limited to, a glass and a ceramic, for example. The term "conductor" as used herein includes, but is not limited to, a metal,for example.

FIG. 2A is a side view illustrating the electrode section 10*a* shown in FIG. 1. FIG. 2B is a front view illustrating the electrode section 10*a* shown in FIG. 1. A side view and a front view of the electrode section 10*b* shown in FIG. 1 would be similar to those shown in FIGS. 2A and 2B, respectively.

The electrode section 10*a* includes a stem 4*a*, the lead-in wires 5*a*-1 and 5*a*-2 mounted into the stem 4*a*, and the filament 6*a* electrically connected to the lead-in wires 5*a*-i and 5*a*-2. The filament 6*a* in electrically connected to the pin 11*a*-1 (FIG. 1) via the lead-in wire 5*a*-1, and to the pin 11*a*-2 (FIG. 1) via the lead-in wire 5*a*-2.

The electrode section 10*a* further Includes the non-conductor structure 7*a* and the conductor structure 8*a*.

As illustrated in FIGS. 2A and 2B, the conductor structure 8*a* is configured to support the non-conductor structure 7*a*. One end of the conductor structure 8*a* is buried in the stem 4*a*. The conductor structure 8*a* is electrically floating (i.e., the conductor structure 8*a* is electrically isolated from the filament 6*a*).

In addition to the elements shown in FIGS. 2A and 2B, the electrode section 10*a* may further include other elements which are conventionally known in the art (e.g., a mercury capsule, an electrode shield, an amalgam, and a thermal Insulation plate).

Referring again to FIG. 1, the operating principle of the fluorescent lamp 1 will now be described.

When the fluorescent lamp 1 is ON, a discharge current flows between the filament 6*a* and the filament 6*b*. The non-conductor structures 7*a* and 7*b* are provided between the filament 6*a* and the filament 6*b* in the fluorescent tube 2. The non-conductor structures 7*a* and 7*b* prevent plasma electrons and tons from travelling along the axis of the fluorescent lamp 1. As a result the electric field distribution in each of cathode regions 50*a* and 50*b*, which are defined in the vicinity of the electrode sections 10*a* and 10*b*, respectively, changes so that the potential gradient of each of the cathode regions 50*a* and 50*b* increases. When the potential gradient of each of the cathode regions 50*a* and 50*b* increases, the discharge current flowing between the filament 6*a* and the filament 6*b* is suppressed. This is because the fluorescent lamp 1 has negative characteristics. By suppressing the discharge current flowing between the filament 6g and the filament 6*b*, it is possible to reduce the power consumption of the fluorescent lamp 1.

The effect of reducing the power consumption is particularly pronounced for a fluorescent lamp 1 which includes a low-wattage type fluorescent tube 2 having a small length along the axis of the fluorescent tube. This is because in such a fluorescent lamp 1, the ratio of the length of each cathode region 50*a*, 50*b* with respect to the total length of the fluorescent lamp 1 is relatively large.

By providing the conductor structures 8*a* and 8*b* between the filament 6*a* and the filament 6*b* in the fluorescent tube 2, the discharge starting voltage i s reduced, thus improving the startability of the fluorescent lamp 1. As a result, it is possible to compensate for reductions in the startability of the fluorescent lamp 1 due to the provision of the non-conductor structures 7*a* and 7*b* between the filament 6*a* and the filament 6*b* in the fluorescent tube 2.

There are two reasons as follows why the discharge starting voltage is reduced by providing the conductor structures 8*a* and 8*b* between the filament 6*a* and the filament 6*b* In the fluorescent tube 2.

The first reason is that a parasitic capacitance (floating capacitance) is produced between the conductor structure 8*a* and the filament 6*a*. This parasitic capacitance (floating capacitance) is shown in FIG. 2A, for example, as a parasitic capacitance (floating capacitance) 100 in broken line. Due to the presence of the parasitic capacitance (floating capacitance), a small discharge occurs before the primary discharge. As a result, the discharge starting voltage is reduced. Similar effects are provided also by a parasitic capacitance which is produced between the conductor structure 8*b* and the filament 6*b*.

The second reason is that the conductor structure 8*a* acts as an auxiliary electrode capable of distorting the electron density distribution along the radial direction of the fluorescent tube 2 and/or distorting the potential gradient along the axis direction of the fluorescent tube 2. Thus, the electric field in the vicinity of the electrode section 10*a* is increased. As a result, the discharge starting voltage is reduced. Similar effects are provided also by the conductor structure 8*b* acting as an auxiliary electrode.

As described above, by providing the non-conductor structures 7*a* and 7*b* between the filament 6*a* and the filament 6*b* in the fluorescent tube 2, it is possible to reduce the power consumption of the fluorescent lamp 1. Moreover, by providing the conductor structures 8*a* and 8*b* between the filament 6*a* and the filament 6*b* in the fluorescent tube 2, it is possible to compensate for reductions In the startability of the fluorescent lamp 1 due to the provision of the non-conductor structures 7*a* and 7*b* between the filament 6*a* and the filament 6*b* in the fluorescent tube 2.

Thus, it is possible to realize the fluorescent lamp 1 in which it is possible to reduce the power consumption while maintaining the startability.

In the example illustrated in FIGS. 2A and 2B, the conductor structure 8*a* and the filament 6*a* are isolated from each other. It is alternatively possible to employ an electrode section of a different type in which a conductor structure and a filament are electrically connected to each other.

FIG. 3 illustrates a structure of a fluorescent lamp 301 having electrode sections 310*a* and 310*b* of the type in which the conductor structure and the filament are electrically connected to each other. In FIG. 3 like elements to those shown in FIG. 1 are provided with like reference numerals and will not be described below.

T he fluorescent lamp 301 includes the electrode section 310*a* (first electrode section) provided at one end of the fluorescent tube 2 and the electrode section 310*b* (second electrode section) provided at the other end of the fluorescent tube 2.

The fluorescent tube 2 further includes provided therein conductor structures 308*a* and 308*b* (second structures). The conductor structures 308*a* and 308*b* are provided between the filament 6*a* and the filament 6*b* in the fluorescent tube 2.

FIG. 4 is a front view illustrating the electrode section 310*a* shown in FIG. 3. A front view of the electrode section 310*b* shown in FIG. 3 would be similar to that shown in FIG. 4.

The electrode section 310*a* includes the conductor structure 308*a*.

In the example illustrated in FIG. 4, the conductor structure 308*a* is configured to support the non-conductor structure 7*a*. The conductor structure 308*a* is electrically connected to the lead-in wire 5*a*-1. The lead-in wire 5*a*-1 is electrically connected to the filament 6*a*. Therefore, the conductor structure 308*a* is electrically connected to the filament 6*a*. The location of the conductor structure 308*a* may be changed so that the conductor structure 308*a* is electrically connected to the lead-in wire 5*a*-2, instead of the lead-in wire 5*a*-1.

In addition to the elements shown in FIG. 4, the electrode section 310*a* may further include other elements which are conventionally known in the art (e.g. a mercury capsule, an electrode shield, an amalgam, and a thermal insulation plate).

Referring again to FIG. 3, the operating principle of the fluorescent lamp 301 will now be described.

When the fluorescent lamp 301 is ON, a discharge current flows between the filament 6*a* and the filament 6*b*. By providing the non-conductor structures 7*a* and 7*b* between the filament 6*a* and the filament 6*b* in the fluorescent tube 2, it is possible to reduce the power consumption of the fluorescent lamp 301. The operating principle is similar to that of the fluorescent lamp 1 described above with reference to FIG. 1.

The conductor structures 308*a* and 308*b* are provided between the filament 6*a* and the filament 6*b* in the fluorescent tube 2 so that the distance between the tips of the conductor structures 308*a* and 308*b* is shorter than the distance between the filaments 6*a* and 6*b*. In the example illustrated in FIG. 3, the distance between the filaments 6*a* and 6*b* Is denoted by Do, with each of the conductor structures 308*a* and 308*b* protruding from the filaments 6*a* and 6*b*, respectively, into the discharge current path by a distance which in denoted by d. As a result, the distance between the tips of the conductor structures 308*a* and 308*b* is ($D_o$−2d).

When the conductor structures 308*a* and 308*b* are not provided, the Inter-electrode distance L of the fluorescent lamp 301 is defined as the distance between the filaments 6*a* and 6*b* (i.e., $D_o$).

When the conductor structures 308*a* and 308*b* are provided, the inter-electrode distance L of the fluorescent lamp 301 is virtually defined as a distance in the range of ($D_o$−2d) to ($D_o$−d).

For example, assume that at the start of a discharge, the electrode section 310*a* including the filament 6*a* acts as a cathode and the electrode section 310*b* including the filament 6*b* acts as an anode. Then, the discharge is likely to be started by thermoelectrons emitted from the filament 64 teaching the tip of the conductor structure 308*b* rather than the filament 6*b*. In such a case, the inter-electrode distance L of the fluorescent lamp 301 is virtually defined as the distance ($D_o$−d) between the filament 6*a* and the conductor structure 308*b*. Alternatively, a discharge may be started as follows. Thermoelectrons emitted from the filament 6*a* cause free electrons of the conductor structure 308*a* to be released therefrom, the free electrons then reaching the tip of the conductor structure 308*b*, thereby starting a discharge. In such a case, the inter-electrode distance L of the fluorescent lamp 301 is virtually defined as the distance ($D_o$−2d) between the respective tips of the conductor structures 308*a* and 308*b*.

Thus, the inter-electrode distance L of the fluorescent lamp 301 is virtually reduced by d to 2d by the provision of the conductor structures 308*a* and 308*b*.

By reducing the inter-electrode distance L of the fluorescent lamp 301, the discharge starting voltage is reduced in accordance with Paschen's law. Thus, the startability of the fluorescent lamp 301 is improved. As a result, it is possible to compensate for reductions in the startability of the fluorescent lamp 301 due to the provision of the non-conductor structures 7*a* and 7*b* between the filament 6*a* and the filament 6*b* in the fluorescent tube 2.

Paschen's law is represented by Expression 1 below.

$$V_s=f(P\cdot L) \qquad \text{Expression 1}$$

Herein, $V_s$ denotes the discharge starting voltage, P denotes the pressure in the fluorescent tube, L denotes the inter-electrode distance, and f denotes a predetermined function.

FIG. 5 is a graph which illustrates Paschen's law. In FIG. 5, the horizontal axis represents the value of P·L, and the vertical axis represents the value of $V_s$. In FIG. 5, a hatched area 60 denotes a range of possible values taken by the product (P·L) of the pressure P in the fluorescent tube 2 and the inter-electrode distance L used for the fluorescent lamp 301.

It can be seen from FIG. 5 that it is possible to reduce the discharge starting voltage $V_s$ by reducing the Inter-electrode distance L under conditions where the pressure P in the fluorescent tube 2 is constant.

As described above, by providing the non-conductor structures 7*a* and 7*b* between the filament 6*a* and the filament 6*b* in the fluorescent tube 2, it is possible to reduce the power consumption of the fluorescent lamp 301. Moreover,.by providing the conductor structures 308*a* and 308*b* between the filament 6*a* and the filament 6*b* in the fluorescent tube·2, it is possible to compensate for reductions in the startability of the fluorescent lamp 301 due to the provision of the non-conductor structures 7*a* and 7*b* between the filament 6*a* and the filament 6*b* in the fluorescent tube 2.

Thus, it to possible to realize the fluorescent lamp 301 in which it is possible to reduce the power consumption while maintaining the startability.

Although the fluorescent lamp 1 (having the electrode sections 10*a* and 10*b* of the type in which the conductor structure and the filament are electrically insulated from each other) and the fluorescent lamp 301 (having the electrode sections 310*a* and 310*b* of the type in which the conductor structure and the filament are electrically connected to each other) operate based on different operating principles, the fluorescent lamps 1 and 301 achieve the same effect of reducing the power consumption of the fluorescent lamp while maintaining the startability thereof.

Similar effects as those described above can be obtained by any operating principle similar to those described above as long as the non-conductor structure and the conductor structure are provided between the filament 6*a* and the filament 6*b* in the fluorescent tube 2.

Next, results of an experiment on the fluorescent lamp 301 will be discussed with reference to FIGS. 6 to 8.

FIG. 6 illustrates the relationship between the distance a U [mm] and the lamp electric power Wla [W] for the fluorescent lamp 301. Herein, d denotes the distance between the non-conductor structure 7*a* and the filament 6*a*, and the distance between the non-conductor structure 7*b* and the filament 6*b*.

In FIG. 6, solid lines 61 to 64 each illustrate the relationship,between d and Wla when ϕ=8, ϕ=12, ϕ=16, ϕ=20, respectively. The experimental conditions are as follows:

Non-conductor structure 7*a*, 7*b*: disc made of soda glass with diameter of ϕ [mm] and thickness of 1 [mm].

Tube length. 585 [mm]

Tube diameter: 27.5 [mm]

Charged gas: mercury (Hg), argon (Ar)

Power sources voltage=100 [V], frequency=60 [Hz]

Stabilizer: copper/iron type stabilizer

Temperature: room temperature

Fluorescent tube: commercially available fluorescent tube (same as fluorescent tube FL20SS/18 from Matsushita Electric Industrial Co., Ltd.)

It is assumed that the lamp electric power Wla of the conventional fluorescent lamp in which neither the conductor structure nor the non-conductor is provided between the opposed filaments in the fluorescent tube is about 17.4 [W].

It can be seen from FIG. 6 that the lamp electric power Wla is reduced by providing the non-conductor structures 7*a* and 7*b* between the filament 6*a* and the filament 6*b* in the fluorescent tube 2. For example, solid line 64 indicates that the lamp electric power Wla is reduced to about 15 [W] by providing the non-conductor structures 7*a* and 7*b* at a position between the filament 6*a* and the filament 6*b* in the fluorescent tube 2 such that d=10. Therefore, by providing the non-conductor structures 7*a* and 7*b*, it is possible to reduce the rap electric power Wla by about 14% from that of the conventional fluorescent lamp (lamp electric power Wla: about 17.4 [W]) in which neither the conductor structure nor the non-conductor structure is provided between the opposed filaments in the fluorescent tube.

In FIG. 6, broken line 65 represents a comparative example with respect to solid lines 61 to 64. The comparative example shows the relationship between d and Wla when iron discs (conductors) each having a diameter of 20 [m] and a thickness of 1 [mm] are provided instead of the non-conductor structures 7*a* and 7*b*, each of which is a disc made of soda glass as described above. The other experimental conditions are as described above.

Broken line 65 indicates that the provision of iron discs (conductors), instead of the non-conductor structures 7*a* and 7*b*between the filament 6*a* and the filament 6*b* in the fluorescent tube 2 only provided an about 2% reduction in the lamp electric power Wla from that of the conventional fluorescent lamp in which neither the conductor structure nor the non-conductor structure is provided between the opposed filaments in the fluorescent tube.

A comparison between broken line 65 and solid line 64 shows that the provision of iron discs (conductors) between the filament 6*a* and the filament 6*b* in the fluorescent tube 2 provides a smaller effect of reducing the lamp electric power Wla as compared to that obtained when the non-conductor structures 7*a* and 7*b* are provided between the filament 6*a* and the filament 6*b* in the fluorescent tube 2.

In FIG. 6, reference numeral 50 denotes a cathode region. The cathode region 50 is a region which is defined in the vicinity of a cathode when a glow discharge is occurring in the fluorescent tube 2. The term "cathode" as used herein refers to an electrode section to which a negative voltage is applied, and the term "anode" as used herein refers to an electrode section to which a positive voltage is applied. An alternating current is applied to the electrode sections 310*a* and 310*b* of the fluorescent lamp 301 (FIG. 3). Therefore, at points in time, the electrode section 310*a* acts as a cathode while the electrode section 310*b* acts as an anode. At other points in time, the electrode section 310*a* acts as an anode while the electrode section 310*b* acts as a cathode.

The cathode region 50 includes a cathode glow space 531, a negative glow space 52, and a Faraday dark space 53. The cathode glow space 51, the negative glow space 52, and the Faraday dark space 53 are arranged in this order from the vicinity of each filament.

The cathode glow space 51 is an bluish green-colored space covering the entire cathode of the fluorescent tube 2 in which a glow discharge is occurring.

The negative glow space 52 is a space adjacent to the cathode glow space 51, which is brighter than the cathode glow space 51 and glows in a bluish white color with the greatest intensity.

The Faraday dark space 53 is a space adjacent to, and darker than, the negative glow space 52.

The space which Is on the anode side with respect to the cathode region 50 is defined as a positive column region 55. The positive column region 55 is a region which glows in a bluish white color.

The above-described colors of the respective regions in the fluorescent tube 2 do not necessarily coincide with the fluorescent colors provided when the fluorescent lamp 301 is turned ON.

In the example illustrated in FIG. 6, the cathode glow space 51 is defined as a space having a range of d=0–3 [mm], the negative glow space 52 is defined as a space having a range of d=3–10 [mm], and the Faraday dark space 53 is defined as; a space having a range of d=10–35 [mm]. Note, however, that these region are mutually diffusive into each other and the boundary therebetween may not be well defined.

It can be seen from FIG. 6 that the effect of reducing the lamp electric power Wla is obtained when the non-conductor structures 7*a* and 7*b* are provided in the Faraday dark space 53. The effect of reducing the lamp electric power Wla is particularly pronounced when the non-conductor structures 7*a* and 7*b* are provided in a region where d=5–20 [mm]. The range of d for which there is provided a substantial effect of reducing the lamp electric power Wla was substantially constant against variations in the diameter of the fluorescent tube 2.

FIG. 7 Illustrates the relationship between the diameter $\phi$ [mm] of the non-conductor structure provided in the fluorescent lamp 301 and the lamp electric power Wla [W]. In FIG. 7, broken line 71, solid line 72, chain line 73, solid line 74 and solid line 75 each represent the relationship between 4 and Wla when d=5, d=10, d=15, d=20 and d=30, 40, 50, respectively.

The definition of d and that of $\phi$ are as described above with reference to FIG. 6, and the experimental conditions are as described above with reference to FIG. 6.

It can be seen from FIG. 7 that the effect of reducing the lamp electric power Wla is obtained when the diameter $\phi$ of the non-conductor structures 7*a* and 7*b* provided between the filament 6*a* and the filament 6*b* in the fluorescent tube 2 is equal to or greater than 12 [mm]. The fluorescent tube 2 used in the experiment had an inner diameter of 26 mm. In this case, the ratio R between the cross-sectional area of each of the non-conductor structures 7*a* and 7*b* along a direction perpendicular to the axis of the fluorescent tube 2 and the cross-sectional area of the fluorescent tube 2 along the direction perpendicular to the axis of the fluorescent tube 2 can be obtained as shown in Expression 2 below.

$$R=(\pi\cdot(12/2)^2)/(\pi\cdot(26/2)^2) \qquad \text{Expression 2}$$

The value of R is about 0.21. Thus, the effect of reducing the lamp electric power Wla is obtained by providing the non-conductor structures 7*a* and 7*b* between the filament 6*a* and the filament 6*b* in the fluorescent tube 2 each of which occupy about 20% or more of the cross-sectional area of the fluorescent tube 2. The effect of reducing the lamp electric power Wla was obtained even when the diameter of the fluorescent lamp 301 was varied as long as the non-conductor structures 7*a* and 7*b* were provided between the filament 6*a* and the filament 6*b* in the fluorescent tube 2 each occupying about 20% or more of the cross-sectional area of the fluorescent tube 2.

It can be seen from the above description that the amount of reduction in the lamp electric power Wla can be controlled by changing the distance between the non-conductor structure 7*a* and the filament 6*a*, the distance between the non-conductor structure 7*b* and the filament 6*b*, the size of the non-conductor structure 7*a*, and the size of the non-conductor structure 7*b*.

By controlling the lamp electric power Wla in this way, the amount of load per unit area applied onto the inner wall of the fluorescent tube 2 is reduced. As a results it is possible to reduce deterioration of the fluorescent substance. Experimental data for the reduction in the deterioration of the fluorescent substance will be discussed below.

FIG. 8 illustrates the relationship between the ON time t [hour] and the relative luminous flux density $\delta$ [%] for the fluorescent lamp 301. Herein, t denotes a total period of time elapsed since the fluorescent lamp 301 is turned ON. The relative luminous flux density $\delta$ is a percent representation of the lamp luminous flux density at a certain point in time, with 100 [%] being the luminous flux density 100 hours after the fluorescent lamp 301 is turned ON.

In FIG. 8, solid line 81 represents the relationship between t and $\delta$ for the fluorescent lamp 301 where d=10 [mm] and $\phi$=20 [mm], and broken line 82 represents the relationship between t and $\delta$ for the conventional fluorescent lamp. The definition of d and that of $\phi$ are as described above with reference to FIG. 6.

It can be seen from FIG. 8 that the rate of decrease in the value $\delta$is suppressed in the fluorescent lamp 301 than in the conventional fluorescent lamp. This means that the deterioration in terms of the lamp luminous flux density is suppressed and the operating life of the lamp is prolonged.

Moreover, the present invention maintains the startability of the fluorescent lamp, as described above. This also prolongs the operating life of the fluorescent lamp because the rate of consumption of an emitter substance which is applied on the surface of the filament (e.g., tungsten) is suppressed.

The fluorescent lamps 1 and 301 merely exemplify various fluorescent lamps of the present invention, and the present invention is not limited to the fluorescent lamps 1 and 301.

For example, it is not always necessary to provide a non-conductor structure in the vicinity of each of the two electrode sections which are provided at opposite ends of the fluorescent tube. The non-conductor structure may be provided in the vicinity of at least one of the two electrode sections. Similarly, a conductor structure may alternatively be provided in the vicinity of at least one of the two electrode sections.

Moreover, the non-conductor structure or the conductor structure is not required to be provided in the vicinity of an electrode section. For example, the non-conductor structure or the conductor structure may alternatively be provided in a region of the fluorescent tube 2 between the filament 6*a* and the filament 6*b* other than in the vicinity of an electrode section.

As described above, the non-conductor structure or the conductor structure may be provided at any position between the filament 6*a* and the filament 6*b* in the fluorescent tube 2. However, in order to effectively reduce the power consumption of a fluorescent lamp, it is preferred to provide a non-conductor structure in the vicinity of each of the two electrode sections which are provided at opposite ends of the fluorescent tube. It is further preferred to provide two non-conductor structures in the vicinity of the axis of the fluorescent tube.

The reasons why such arrangements are preferred will now be described.

In a fluorescent lamp, the positive column region has a very small potential gradient per unit length, whereas the cathode region has a large potential gradient per unit length. The discharge current flowing through a fluorescent lamp is substantially attributable to movement of electrons. Electrons are substantially accelerated in the cathode region, which has a large potential gradient. As a result, the electrons obtain kinetic energy. Therefore, the discharge current is effectively suppressed by inhibiting the flow of electrons by providing a non-conductor structure in the cathode region in the vicinity of an electrode section. As a result, it is possible to reduce the power consumption of the fluorescent lamp.

Stance the ratio of the length of the cathode region with respect to the total length of the fluorescent lamp is small, the contribution of the cathode region to the lamp emission is smaller than the contribution of the positive column region to the lamp emission. Therefore, by providing a non-conductor'structure In the cathode region, it is possible to reduce the power consumption while minimizing the amount of decrease in the emission efficiency of the fluorescent lamp.

The plasma electron density is relatively high in the vicinity of the axis of the fluorescent tube, whereas the electron density ts low in the vicinity of the inner wall of the fluorescent tube. Therefore, by providing a non-conductor in the vicinity of the axis of the fluorescent tube, a substantial effect of reducing the lamp electric power is obtained even when the size of the non-conductor structure itself is small. Therefore, the need for attachment of a large structure is eliminated, thereby improving the practicability and the mechanical strength.

The non-conductor structure does not need to be provided as a part of an electrode section. For example, the non-conductor structure may alternatively be provided as a separate member from the electrode section.

Similarly, the conductor structure does not need to be provided as a part of an electrode section. For example, the conductor structure may alternatively be provided as a separate member from the electrode section. For example, the conductor structure may be a conductive coating film applied on the inner wall of the fluorescent tube. Where a conductive coating film is used as the conductor structure, it is preferred to provide the conductive coating film so that the distance between the conductive coating film and a filament is short, so as to ensure a desirable startability of the fluorescent lamp. This is because a parasitic capacitance (floating capacitance) occurs more easily when the distance between the conductive coating film and the filament is shorter.

Where the non-conductor structure and the conductor structure are each provided as a part of an electrode section, the fluorescent tube (e.g., a glass tube) and the electrode section may be produced separately In the production process of a fluorescent lamp. Therefore, no modification is required for steps in the conventional fluorescent lamp production process, e.g., the fluorescent substance application step and the glass tube bending step. Moreover, the present invention can be used in a wide variety of applications, including fluorescent lamps having a complicated shape, e.g., a fluorescent lamp obtained by bending a fluorescent tube or a fluorescent lamp obtained by bridge-coupling of a number of fluorescent tubes.

The non-conductor structure does not need to be supported by the conductor structure. For example, the conductor structure may alternatively be provided separately from a member for supporting the non-conductor structure. However, it is preferred that the conductor structure also functions as a member for supporting the non-conductor structure, in order to reduce the number of parts of the electrode section.

Moreover, the conductor structure does not need to be the whole of a member for supporting the non-conductor structure, but may alternatively be only a part of such a member. Thus, a supporting member may include the conductor structure.

A fluorescent substance may be applied on the non-conductor structure and the conductor structure. In such a case, due to the applied fluorescent substance, an increased emission can be expected.

The electrode sections provided at opposite ends of the fluorescent tube may have different structures. For example, the first electrode section may be the electrode section 10*a* (FIGS. 2A and 2B), and the second electrode section may be the electrode section 310*b* (having a similar shape as that of the electrode section 310*a* shown in FIG. 4). Alternatively, the first electrode section may be the electrode section 310*a*, and the second electrode section may be the electrode section 10*b*.

FIGS. 9A to 9G illustrate exemplary shapes f or the non-conductor structure 7*a* used in the electrode section 10*a* (FIGS. 2A and 2B) of the type in which the conductor structure and the filament are electrically insulated from each other. The non-conductor structure 7*b* may have shapes similar to those illustrated for the non-conductor structure 7*a*.

FIG. 9A illustrates an example where the non-conductor structure 7*a* has a ring shape. When a non-conductor structure having such a shape is used, the diameter of the discharge current path in the fluorescent tube is reduced, thereby increasing the plasma density along the axis of the fluorescent tube. This stabilizes the discharge and Increases the rate of recombination between electrons and tons. Therefore, the decrease in the lamp emission efficiency is suppressed. Similar effects can be obtained also when the ring has a shape other than the illustrated circular shape, e.g., a polygonal shape.

FIG. 9B illustrates an example where the non-conductor structure 7*a* has a disc shape with an aperture therein. When a non-conductor structure having such a shape is used, it is possible to obtain effects similar to those obtained when using the non-conductor structure 7*a* having a shape as Illustrated in FIG. 9A. Similar effects can be obtained also when the disc with an aperture has a shape other than the illustrated circular shape, e.g., a polygonal shape.

FIG. 9C illustrates an example where the non-conductor structure 7*a* has a spherical shape.

FIG. 9D illustrates an example where the non-conductor structure 7*a* has a cylindrical shape.

FIG. 9E illustrates an example where the non-conductor structure 7*a* has a polygonal cylinder shape.

FIG. 9F illustrates an example where the non-conductor structure 7*a* has a hollow cylindrical shape.

FIG. 9G illustrates an example where the non-conductor structure 7*a* has a hollow polygonal cylinder shape.

When a non-conductor structure having one of the shapes illustrated in FIGS. 9C to 9G is used, it is possible to increase the volume in the fluorescent tube in which the discharge current is suppressed. This is because such a non-conductor structure has a dimension along the axis of the fluorescent tube. As a result, the effect of reducing the power consumption of the fluorescent lamp is increased.

When the non-conductor structure 7*a* includes an angled corner such as those in the shapes illustrated in FIGS. 9E and 9G, the plasma electromagnetic field distribution can be made non-uniform by the edge effect.

The electric field along the axis of the fluorescent tube can alternatively be controlled by changing the profile of the non-conductor structure 7*a* along the axis of the fluorescent tube.

The non-conductor structures 7*a* and 7*b* respectively used in the electrode sections 310*a* and 310*b* of the type in which the conductor structure and the filament are electrically connected to each other may have any shape similar to those for the non-conductor structure 7*a* illustrated in FIGS. 9A to 9G.

FIGS. 10A to 10D illustrate further exemplary shapes for the non-conductor structure 7*a* used In the electrode section 10*a* (FIGS. 2A and 2B) of the type in which the conductor structure and the filament are electrically insulated from each other. In each of these examples, the non-conductor structure 7*a* surrounds the filament 6*a*. The non-conductor structure 7*b* may have shapes similar to those illustrated for the non-conductor structure 7*a*.

FIG. 10A Illustrates an example where the non-conductor structure 7*a* has a dome shape.

FIG. 10B illustrates an example where the non-conductor structure 7*a* has a tubular shape.

FIG. 10C illustrates an example where the non-conductor structure 7*a* has a cone shape.

FIG. 10D illustrates an example where the non-conductor structure 7*a* has a configuration including a combination of a disc and a tube. In the example illustrated in FIG. 10D, the non-conductor structure 7*a* includes a structure 7*a*-1 having a disc shape and a structure 7*a*-2 having a tubular shape.

When the non-conductor structure 7*a* is provided to surround the filament 6*a*, as illustrated in FIGS. 10A to 10D, the effect of suppressing the discharge current is increased. As a result, the effect of reducing the power consumption is increased. Moreover, any emitter substance discharged from a filament is not attached to the inner wall of the fluorescent tube but is attached to the inner wall of the non-conductor structure. As a result, it is possible to prevent the brightness of a fluorescent lamp from falling during the last period of the operating lifetime of the fluorescent lamp due to the blackening of the inner wall of the fluorescent tube.

When a non-conductor structure having one of the shapes illustrated in FIGS. 10A, 10C and 10D Is used, an aperture may be provided in the center of the non-conductor structure for the purpose of adjusting the amount by which the discharge current is suppressed by the non-conductor structure.

The non-conductor structure 7*a*-2 having a tubular shape as illustrated in FIG. 10D may be replaced by a conductor having a similar shape, so that the conductor functions as a conductor electrode shield, which is conventionally known as an element of an electrode section. In such a case, the member for supporting the electrode shield and the member for supporting the non-conductor structure can be integrated into a single member. This provides an advantage that the number of parts of the electrode section 7*a* can be reduced.

The non-conductor structures 7*a* and 7*b* respectively used in the electrode sections 310*a* and 310*b* of the type in which the conductor structure and the filament are electrically connected to each other may have any shape similar to those for the non-conductor structure 7*a* illustrated in FIGS. 10A to 10D.

As described above, various shapes can be used for the non-conductor structure. Similarly, various shapes can be used for the conductor structure. For example, the conductor structure may have a rod shape or a tubular shape.

FIGS. 11A and 11B illustrate exemplary shapes for the conductor structure 308*a* used in the electrode section 310*a* (FIG. 4) of the type in which the conductor structure and the filament are electrically connected to each other. The conductor structure 308*b* may have similar shapes.

FIG. 11A illustrates an example where the conductor structure 308*a* is connected to the lead-in wire 5*a*-1.

FIG. 11B illustrates an example where the conductor structure 308*a* Is integral with the lead-in wire 5*a*-1. In such a case, there is provided an advantage that the number of parts which must be provided in the electrode section during the production of a fluorescent lamp can be reduced.

Embodiment 2

FIGS. 12A and 12B each illustrate a structure of an electrode section 610*a* including a member 608*a* for movably supporting the non-conductor structure 7*a*. The electrode section 610*a* can be used to replace at least one of the electrode sections 10*a* and 10*b* of the fluorescent lamp 1 illustrated In FIG. 1. Alternatively, the electrode section 610*a* can be used to replace at least one of the electrode sections 310*a* and 310*b* of the fluorescent lamp 301 illustrated in FIG. 3.

In the example illustrated in FIG. 12A and 12B, the supporting member 608*a* includes a fixed section 611*a*, a movable section 651*a*, a fixed section 612*a*, a movable section 652*a*, and a fixed section 613*a*. The movable sections 651*a* and 652*a* can movably support the non-conductor structure 7*a*.

For example, the movable sections 651*a* and 652*a* can be obtained by layering together two different metals 700 and 800 having different thermal expansion coefficients. The movable sections 651*a* and 652*a* deform in response to a change in the temperature of the movable sections 651*a* and 652*a* themselves, or a change in the environment temperature around the movable sections 651*a* and 652*a*. When the fluorescent lamp is ON, heat is generated inside the fluorescent tube due to the discharge current. The generated heat causes the movable sections 651*a* and 652*a* to deform so as to redirect the non-conductor structure 7*a* as shown by arrow 130. As a result, the posture of the supporting member 608*a* changes from the posture shown in FIG. 12A to that shown in FIG. 12B.

FIG. 12A illustrates the posture of the supporting member 608*a* at the start of a discharge. During a predetermined amount of time following start of flow of a discharge current, the supporting member 608*a* supports the non-conductor structure 7*a* so that the non-conductor structure 7*a* is moved out of the discharge current path. During such a period of time, it is not required for the entire portion of the non-conductor structure 7*a* to be moved out of the discharge current path. During such a period of time, at least a portion of the non-conductor structure 7*a* may be moved out of the discharge current path.

FIG. 12B illustrates the posture of the supporting member 608*a* which ts assumed after the discharge is maintained for a certain period of time. When a predetermined amount of time elapses after the start of the discharge current flow, the non-conductor structure 7*a* is supported so that the non-conductor structure 7*a* is moved the discharge current path.

The operating principle of the fluorescent lamp having the electrode section 610*a* will now be described.

At the start of a discharge, the non-conductor structure 7*a* assumes a position so as not to inhibit the electron flow of the discharge current (see FIG. 12A), thereby ensuring the startability of the fluorescent lamp. When a certain amount of time elapses after the start of the discharge, the non-conductor structure 7*a* is moved in a position so as to block the discharge current path (see FIG. 12B). Thus, it ts possible to reduce the power consumption of the fluorescent lamp. The principle based on which the power consumption of the fluorescent lamp is reduced is similar to that described in Embodiment 1 above.

By using the electrode section 610*a* as an electrode section of a fluorescent lamp, it is possible to realize a fluorescent lamp in which it is possible to reduce the power consumption while maintaining the startability.

The structure of the supporting member 608*a* is not limited to that shown in FIGS. 12A and 12B. The supporting member 608*a* may employ any other structure as long as the supporting member 608*a* supports the non-conductor structure 7*a* so that at least a portion of the non-conductor structure 7*a* is moved out of the discharge current path during a predetermined amount of time following start of flow of a discharge current, and the supporting member 608*a* supports the non-conductor structure 7*a* so that the non-conductor structure 7*a* is moved in the discharge current path after the predetermined &mount of time following start of flow of a discharge current.

For example, the supporting member 608*a* may include any number of movable sections. The mechanism for the movement of the movable sections is not limited to that described above. The supporting member 608*a* does not need to be mounted into the stem 4*a*. For example, the supporting member 608*a* may alternatively be connected to the tip of the lead-in wire 5*a*-1 or the lead-in wire 5*a*-2.

The supporting member 608*a* may be made of either a non-conductor or a conductor. Alternatively, the supporting member 608*a* may include a non-conductor portion and a conductor portion.

In the example illustrated in FIGS. 12A and 12B, the non-conductor structure 7*a* and the supporting member 608*a* are provided as parts of the electrode section 610*a*. Alternatively, the non-conductor structure 7*a* and the supporting member 608*a* may be provided separately from the electrode section 610*a*.

When both of the non-conductor structure 7*a* and the supporting member 608*a* are provided as parts of the electrode section 610*a*, the fluorescent tube and the electrode section 610*a* may be separately produced in the production process. Therefore, no modification is required for steps in the conventional fluorescent lamp production process, e.g., the fluorescent substance application step and the glass tube bending step. Moreover, the present invention can be used in a wide variety of applications, including fluorescent lamps having a complicated shape, e.g., a fluorescent lamp obtained by bending a fluorescent tube or a fluorescent lamp obtained by bridge-coupling of a number of fluorescent tubes.

A fluorescent substance may be applied on the non-conductor structure 7*a* and the supporting member 608*a*. In such a case, due to the applied fluorescent substance, an increased emission can be expected.

The non-conductor structure 7*a* may have any of the shapes illustrated In FIGS. 9A to 9G and 10A to 10D.

The fluorescent lamps according to Embodiment 1 and Embodiment 2 of the present invention aim to reduce the power consumption by suppressing the discharge current. Therefore, the brightness may be lower than that obtained when the discharge current is not suppressed. However, the reduction in the brightness can be compensated for by employing a fluorescent substance having a two-band type spectral distribution, which provides a more efficient fluorescent emission as compared to a conventional fluorescent substance having a three-band type spectral distribution. For example, with a two-band type fluorescent lamp capable of categorical color perception as described in Simizu, at al., "Two-Band Type Fluorescent Lamp", National Technical Report, Vol. 43, No. 2, pp. 174–180, (1997), it is possible to increase the total luminous flux density by 20% to 30% with respect to a fluorescent lamp of the same power standard and of the same lamp electric power. By employing such a fluorescent lamp, it is possible to realize a fluorescent lamp capable of categorical color perception and having a lamp efficiency 20%–30% greater than that of a conventional fluorescent lamp for the same total luminous flux density.

The two-band type fluorescent lamp "capable of categorical color perception" as used herein refers to a fluorescent lamp which ts designed based on the "categorical color perception" instead of the general color rendering index Ra as an index of color perception.

The general color rendering index Ra is an index used to evaluate how the color is perceived, e.g., the vividness, or the obscureness. The general color rendering index Ra is determined based on how well a sample light source renders a color as compared to a reference light source.

The "categorical color perception", on the other hand is a concept of identifying a color as one of a number of color categories that are distinctively perceived by a human, and the concept is not based on how the color is perceived. According to this concept, the only determination is as to whether a "red color", for example, is recognized as being "red" or not, and how the color to perceived, e.g., the vividness of the "red", or the obscureness of the "red", is not determined.

A two-band type fluorescent lamp "capable of categorical color perception", as compared to a commercialally-available fluorescent lamp, can be characterized In tat it is designed while giving much more weight to the lamp efficiency, than to the color rendering properties of the lamp. Such a fluorescent lamp is suitable as, for example, a light source for traffic signs (particularly a light source for tunnel lighting). This is because a light source for use with traffic signs is only required to distinguish a number of colors (e.g., six colors as follows: green, yellow, red, blue., white and orange) used in traffic signs on traffic signboards or on the road surface, and the color rendering properties of such a light source does not matter.

By employing a fluorescent substance having a two-band type spectral distribution capable of categorical color perception (e.g., a fluorescent substance which has been used in the two-band type fluorescent lamp described in the above article which is capable of categorical color perception) as a fluorescent substance of the power saving fluorescent lamp of the present invention, it is possible to realize a fluorescent lamp capable of categorical color perception and having a reduced power consumption with a brightness that is comparable to that of conventional fluorescent lamps.

It is possible to further improve the power saving effect by charging a mixed gas containing an argon gas and a gas other than an argon gas into the fluorescent lamp.

As described above, by providing the non-conductor structure between the first filament and the second filament in the fluorescent tube, it is possible to reduce the power consumption of the fluorescent lamp. Moreover, by providing the conductor structure between the first filament and the second filament in the fluorescent tube, it is possible to compensate for reductions in the startability of the fluorescent lamp due to the provision of the non-conductor structure between the first filament and the second filament in the fluorescent tube.

Thus, it is possible to realize a fluorescent lamp in which it is possible to reduce the power consumption while maintaining the startability.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fluorescent lamp, comprising:

a first electrode section having a first filament;

a second electrode section having a second filament;

a fluorescent tube in which a fluorescent substance is applied on an inner wall of the fluorescent tube;

a first structure of a non-conductor provided in the fluorescent tube; and a second structure of a conductor provided in the fluorescent tube, wherein the first structure and the second structure are provided between the first filament and the second filament;

the first structure surrounds the first filament, and a distance between the first structure and the first filament is 5 mm to 20 mm.

2. A fluorescent lamp according to claim 1, further comprising a member for supporting the first structure, wherein the supporting member Includes the second structure.

3. A fluorescent lamp according to claim 1, wherein the second structure is electrically insulated from the first filament.

4. A fluorescent lamp according to claim 1, wherein second structure is electrically connected to the first filament.

5. A fluorescent lamp according to claim 1, wherein the fluorescent substance has a two-band type spectral distribution capable of categorical color perception.

6. A fluorescent lamp according to claim 1, wherein a cathode region is defined as an area proximate the first electrode section, and the first structure is provided in the cathode region.

7. A fluorescent lamp according to claim 1, wherein a cross-sectional area of the first structure along a direction perpendicular to an axis of the fluorescent tube is equal to or greater than 20% of a cross-sectional area of the fluorescent tube along the direction perpendicular to the axis of the fluorescent tube.

8. A fluorescent lamp according to claim 1, wherein a fluorescent substance is applied on the first structure and the second structure.

9. A fluorescent lamp, comprising:

a first electrode section having a first filament;

a second electrode section having a second filament;

a fluorescent tube for the producing a fluorescent emission in response to a discharge current flowing between the first filament and the second filament;

a non-conductor structure provided in the fluorescent tube; and a member for movably supporting the non-conductor structure, wherein in the supporting member supports the non-conductor structure so that at least a portion of the non-conductor structure is moved out of the path of the discharge current during a predetermined amount of time following start of flow of a discharge current, and the supporting member supports the non-conductor structure so that the non-conductor structure is moved in the discharge current path after the predetermined amount of time following the start of flow of a discharge current.

* * * * *